United States Patent [19]

Miesch et al.

[11] Patent Number: 4,964,641

[45] Date of Patent: Oct. 23, 1990

[54] GOLF CLUB WITH ELECTRICAL DISCHARGE MACHINED FACE

[75] Inventors: Gary D. Miesch, Gowen; Gregg D. Miesch, Comstock Park; Donald H. Miesch, Grand Rapids, all of Mich.

[73] Assignee: Diversified Metal Incorporated, Grand Rapids, Mich.

[21] Appl. No.: 470,922

[22] Filed: Jan. 26, 1990

[51] Int. Cl.[5] ..... A63B 53/04

[52] U.S. Cl. ..... 273/175; 273/173

[58] Field of Search ..... 273/175, 167 J, 173, 273/174, 78, 168, 167 R

[56] References Cited

U.S. PATENT DOCUMENTS

| | | | |
|---|---|---|---|
| D. 57,980 | 5/1921 | Kraeuter | D21/217 |
| D. 63,284 | 11/1923 | Challis | D21/217 |
| D. 71,942 | 2/1927 | Hodgkins | D21/217 |
| D. 162,054 | 2/1951 | Markovich | D21/217 |
| D. 190,034 | 4/1961 | Penna | D21/217 |
| D. 190,430 | 5/1961 | Penna | D21/217 |
| 669,864 | 3/1901 | Simpson | 273/175 |
| 722,927 | 3/1903 | Swift | 273/175 |
| 749,174 | 1/1904 | Davis | 273/80.1 |
| 1,511,479 | 10/1924 | Kelly et al. | 273/164 |
| 1,927,083 | 9/1933 | Davis | 273/175 |
| 2,005,401 | 6/1935 | Storz | 273/175 |
| 2,457,084 | 12/1948 | Kearsley et al. | 273/169 |
| 2,486,952 | 11/1949 | Kearsley et al. | 273/169 |
| 3,693,978 | 9/1972 | East | 273/167 F |
| 4,367,877 | 1/1983 | Gibson | 273/164 |
| 4,754,970 | 7/1988 | Kobayashi | 273/77 A |
| 4,754,971 | 7/1988 | Kobayashi | 273/77 A |
| 4,768,787 | 9/1988 | Shira | 273/175 |

*Primary Examiner*—George J. Marlo

*Attorney, Agent, or Firm*—Price, Heneveld, Cooper, DeWitt & Litton

[57] ABSTRACT

A golf club such as a putter includes a club head attached to a shaft. The club head includes a ball striking surface or front face. The surface is finish machined to a flatness tolerance of ±0.001 inches. The face includes an electrical discharge machined pattern which reduces surface contact area, increases the coefficient of friction of the surface resulting in an improved feel and reduced stroke length to achieve the correct or desired distance.

20 Claims, 1 Drawing Sheet

GOLF CLUB WITH ELECTRICAL DISCHARGE MACHINED FACE

BACKGROUND OF THE INVENTION

The present invention relates to golf clubs and more particularly to a golf club having an improved face or ball striking surface.

A typical set of golf clubs includes a putter, a series of irons and a series of woods. The clubs have heads of varying loft. The clubs may also have varying shaft lengths. As the loft increases, golf ball distance will generally decrease and trajectory height will increase. With irons and woods, the ball striking face is typically grooved to increase friction between the ball and club face. The grooving tends to impart spin to the ball. Spin helps to maintain the ball on line and affects the aerodynamics of ball flight. The majority of putters in use today have a relatively smooth face. In addition, the face has a minimal loft angle. Generally, the golf ball will skid or slide for a short distance after being struck by the putter. Friction between the ball and putting surface eventually imparts spin to the ball. This skidding or sliding action can result in the ball going off line. While normal manufacturing tolerances have heretofore been thought to be sufficient, deviations in flatness of the putter face can result in off line putts.

Various attempts have been made to improve the ball striking surface of golf clubs. One example is found in U.S. Pat. No. 4,768,787 which issued on Sept. 6, 1988 to Shira. As shown therein, a golf club has a metallic golfball striking surface which includes a plurality of hard particles embedded therein which increase the surface coefficient of friction. Portions of the particles protrude above the surface so as to provide greater frictional grip between the golfball striking surface and the golfball.

Other examples of attempts to increase the coefficient of friction of the ball striking surface may be found in U.S. Pat. No. 669,864 entitled GOLF CLUB and issued on Mar. 12, 1901 to Simpson; U.S. Pat. No. 722,927 entitled GOLF STICK and issued on Mar. 17, 1903 to Swift; U.S. Pat. No. 749,174 entitled PUTTER and issued on Jan. 12, 1904 to Davis; U.S. Pat. No. 4,754,970 entitled GOLF CLUB SET and issued on July 5, 1988 to Kobayashi; and U.S. Pat. No. 4,754,971 entitled GOLF CLUB SET and issued on July 5, 1988 to Kobayashi. Each of the Kobayashi patents disclose golf club sets wherein the striking surface of the club head has a coefficient of friction which varies with the angle of the loft of the club. Patents such as Davis are representative of prior approaches which roughen the ball striking surface to increase the friction between the ball and the club head.

Heretofore, manufacturing and finishing processes especially on golf putter faces, have been inadequate. Present flatness tolerances even though within the range of ±0.005 to 0.110 inches, result in off line putts which are magnified by the required stroke length to achieve a desired distance.

A need exists, therefore, for an improved finishing method and golf ball striking surface which provides increased accuracy, an increased coefficient of friction to eliminate skidding, a reduced surface contact area to achieve an improved feel, and which permits the use of a reduced stroke length necessary to achieve a correct or desired distance.

SUMMARY OF THE INVENTION

In accordance with the present invention, the aforementioned needs are substantially fulfilled. In one aspect of the invention, a method is provided for finishing a golfball striking surface or face made from a ferrous or non-ferrous metal. Initially, the face is thoroughly cleaned to remove dirt, paint, corrosion, oxidation or plating therefrom. A finish machining operation is performed which improves flatness of the surface. Next a pattern is formed in the face through an electrical discharge machining process. The process heat treats the face, reduces the surface area of the face which contacts the ball and substantially increases the coefficient of friction. In the preferred form, the pattern includes a plurality of intersecting lines which define a plurality of pits. The pits are pyramidal in shape. The process may produce a waffle or diamond pattern.

The golf club in accordance with the present invention includes a club head having a golf striking surface finished in accordance with the above described method. In the presently preferred form, the golfball striking surface or face has a flatness deviation of less than 0.005 inches and preferably about 0.0010 inches. An electrical discharge machined pattern on the surface increases surface hardness and friction. It is presently preferred that the pattern be waffle or diamond shaped having a plurality of pits or squares spaced about 0.040 inches on center and which have a depth to an apex of about 0.013 inches.

The pattern reduces the surface area of the ball contacting face. The tightness of the pattern permits the grooves or pits to enter the dimples on the golfball surface. The golfball will have improved action off of the putter face creating a clean solid feel and reducing the effort required to putt a ball a given distance when compared to a conventional putter. Reduced effort permits a decrease in the length of the back swing which reduces the chance for error. The surface flatness, maintained to a tolerance of ±0.001 inches, results in an improved sweet spot and a consistent putting surface. The pattern increases the coefficient of friction between the golfball and putter face. This imparts overspin to the ball eliminating skidding or sliding action. The gyroscopic action of the overspin lessens the chance of ball deflection caused by debris, moisture or the like which may be present on the putting green. The electrical discharge machined surface is wear resistant. The surface and pattern will not breakdown or deform after prolonged use. During the electrical discharge machining process, localized heating to temperatures over 2000° F. hardens the putter face through heat treating.

The concepts of the present invention may be equally applied to ferrous and non-ferrous metal irons, putters and metal woods. In addition, the process can be applied to metal inserts attached to the faces of nonmetal or metal club heads.

DETAILED DESCRIPTION OF THE PREFERRED EMBODIMENT

Figure 1:
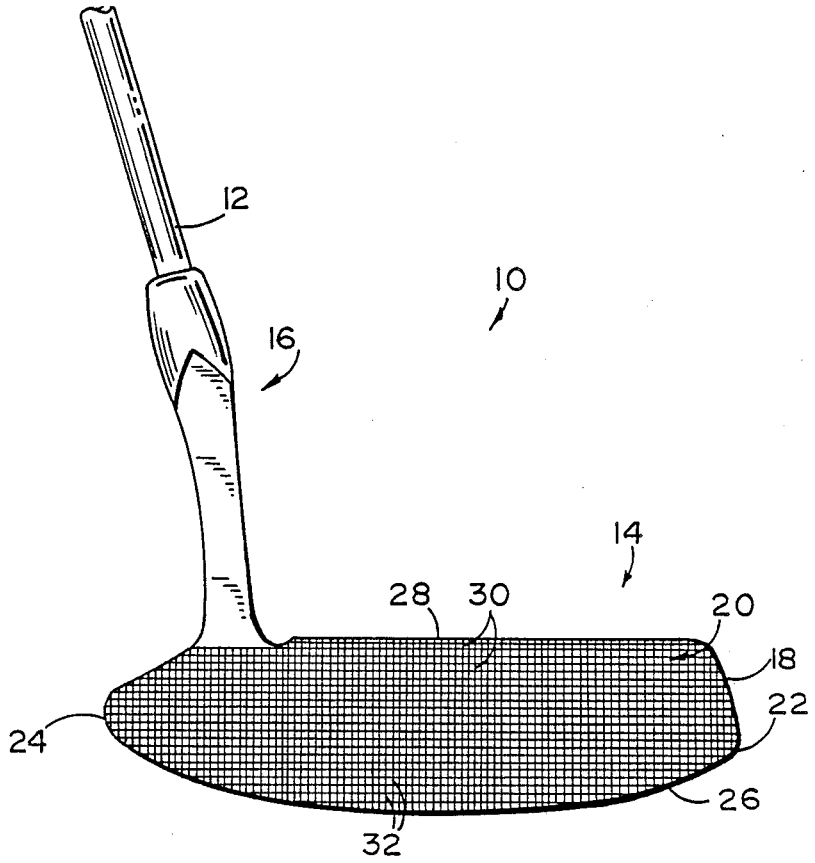
FIG. 1 is a front, elevational view of a golf club in accordance with the present invention.

A golf club in accordance with the present invention is illustrated in FIG. 1 and generally designated by the numeral 10. Club 10 includes a shaft 12 and a club head 14. Club head 14 includes an offset hostel 16 which is attached to shaft 12 in a conventional fashion. Club 10 is typically referred to as a putter. The invention may, however, be applied to other clubs such as metal irons or woods.

Head 14 includes a body 18 which has a golfball striking surface or face 20 formed thereon or joined thereto. Surface 20 may be integral with the head or a multiple piece head construction using an insert may define the surface. Golf club head 14, in addition, includes a rear face (not shown), a toe area 22, a heel area 24 and a sole 26.

Figure 4:
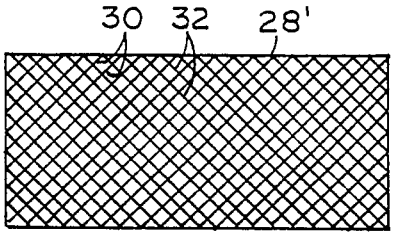
FIG. 4 is a front, elevational view of a portion of a golfball striking surface showing an alternative pattern in accordance with the present invention.

As shown in FIG. 1, surface 20 is formed with a pattern 28 defined by a plurality of generally perpendicular lines 30, 32 which intersect in a regular square pattern. The lines bound the outer peripheries of inwardly directed pits, depression or concavities. In the preferred form, the pits are generally pyramidal in shape having four sides and terminating in an apex. The pattern may be formed on the entire surface 20 extending from upper and lower edges of the club face and between the heel and toe portions thereof. In the alternative, the pattern may be applied to a principal "sweet spot" or central area of the club face. The pattern, shown in FIG. 1 is a generally waffle pattern consisting of a series of repeating squares. In the alternative, the putter may be as shown in FIG. 4 wherein the repeating squares are on diagonals and have a diamond pattern 28'.

The pattern is formed in the club face employing an electrical discharge machining (EDM) operation. Such operations are based on the principle of erosion of metals by spark discharges. The spark is a transient electrical discharge through a space between two charged electrodes, namely a work piece and a tool. The discharge occurs when the potential difference between the tool electrode and the work piece electrode is large enough to cause a breakdown in the medium used to procure an electrically conductive spark channel. In typical electrical discharge machining processes, the breakdown potential is established by connecting two electrodes to the terminals of a condenser charged from a power source. The spacing between the tool and work piece is critical and feed is usually controlled by servo mechanisms. The discharge can be repeated rapidly. Each time a minute amount of the work piece material is removed. Electrical discharge machining operations can be used to generate almost any geometry if a suitable tool electrode can be fabricated and brought into close proximity to the work piece.

Figure 2:
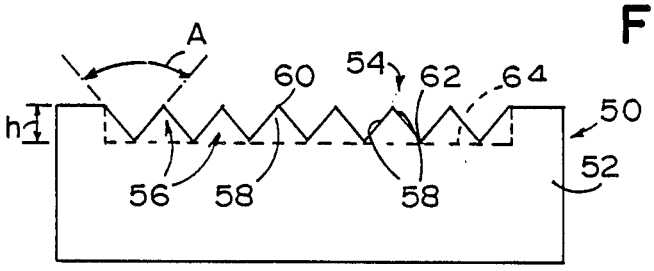
FIG. 2 is a greatly enlarged side, elevational view of an electrical discharge machining electrode used in the present invention.
Figure 3:
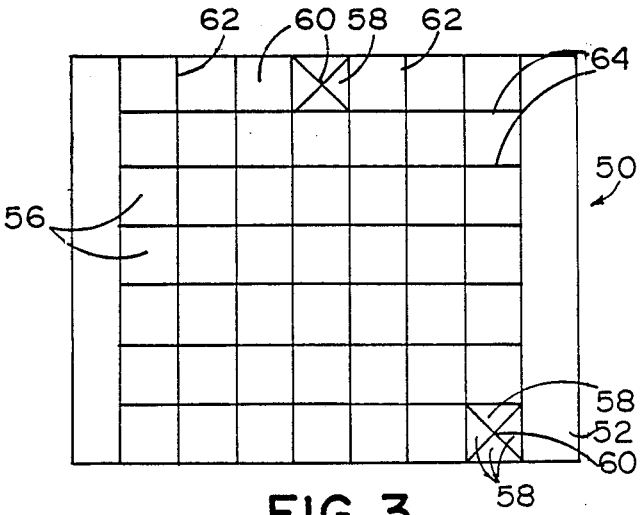
FIG. 3 is a greatly enlarged top, plan view of the electrode of FIG. 2.

A tool electrode employed in the present invention is illustrated in FIGS. 2 and 3 and generally designated by the numeral 50. As shown in FIGS. 2 and 3, electrode 50 includes a body 52 having an upper surface 54. Surface 54 is formed with a series of four-sided pyramids 56 each having sides 58 which terminate in an apex 60. The pyramids are separated by transverse grooves or lines 62 and longitudinal grooves or lines 64.

Electrode 50 may be fabricated from graphite, copper or brass. The electrode body is first ground or machined square, flat and parallel. The pattern is then formed by a grinding or other machining operation on the electrode surface. Once completed, the electrode is ready for mounting in a special fixture attached to an EDM machine tool platen. The platen orients the electrode to the desired position.

The club heads 14 are then prepared. The surface 20 of the head or of a separate insert, is thoroughly cleaned to remove dirt, paint, corrosion, oxidation or plating which may be present from the casting, machining or forging operation employed to form the basic club head body or insert. Surface 20 is then ground flat maintaining a precise flatness or surface deviation tolerance. The tolerance may be within the range of 0.001 to 0.005 inches. It is preferred, however, that a tolerance of about ±0.001 inches be maintained. The surface tolerance should be less than 0.005 inches in order to achieve the desired results and minimize off line putts.

To form the pattern of FIG. 1, the electrode 50 is positioned on the tool platen so that lines 64 are parallel to the longitudinal axis of the face 20. The putter head is nested in position on the EDM machine tool work table. The platen is then lowered into position to start the burning process. Upon reaching a desired burn depth, the platen is retracted to an up position. The putter head is then removed, cleaned and prepared for assembly. The platen may be oriented to position the electrode 50 so that it extends at a diagonal or 45° angle with respect to the longitudinal axis of the face 20. When so positioned, a diamond pattern 28' as illustrated in FIG. 4 is obtained. Other patterns could also be used.

It is presently preferred that the angle "a" of the tool 50 as shown in FIG. 2 be about 80°. The on center spacing between the apices 60 is within the range 0.040 to 0.160 inches. It is presently preferred that the on center spacing be about 0.040 inches. The height between the top of the apex and the base of the pyramid structure or grooves 62,64 is within the range of 0.025 inches to 0.10 inches with a height of 0.025 inches being preferred. The burn depth in the face or surface 20 of head 14 is within the range of 0.013 inches to 0.035 inches. A depth of 0.013 inches is preferred with an apex on center spacing of 0.40 inches and a pyramid height of 0.025 inches.

The pattern produced by the EDM process substantially increases the coefficient of friction over that of a conventional putter surface on the order of ten to twenty times. A conventional putter face has been tested to have a coefficient of friction of about 1.2. A putter in accordance with the present invention has a coefficient of friction in excess of 11.5. The increased coefficient of friction results in an increase in the overspin imparted to the ball immediately upon contact. The club face creates a true roll. Skidding and sliding of the ball during the initial few inches of travel are eliminated. This eliminates one source of potential deflection from the intended line due to contact with debris or moisture present on the putting surface.

The EDM operation heat treats or hardens the putter face. The process results in intense localized heating generally over 2000° F. This hardening of the putter face coupled with the reduction in the surface contact area due to the presence of the pits significantly reduces the effort or back stroke length required to achieve a particular distance. In testing with a mechanical swing fixture and a 12 inch back swing, a putter having a face in accordance with the present invention versus an identical putter but having no surface pattern, achieved a roll of approximately 10.2 feet versus 7.5 feet for the conventional putter. The reduced putter face deviation substantially eliminates off line putts. A flatness deviation within the range of 0.020 to 0.10 results in off line putts of 4.8 inches to 24 inches based upon a 20 foot putt. A putter in accordance with the present invention having a deviation of 0.001 inches results in an off line putt of approximately 0.024 inches. Such represents significant improvements over putting accuracy.

In view of the foregoing description those of ordinary skill in the art may envision various modifications which would not depart from the invent of concepts disclosed herein. It is expressly intended, therefore, that the above should be considered as only a description of the preferred embodiment. The true spirit and scope of the present invention may be determined by reference to the appended claims.

The embodiments of the invention in which an exclusive property or privilege is claimed are defined as follows.

1. A method of finishing a golf club of the type having a head defining a front face adapted to engage a golf ball, said method comprising the steps of:

cleaning the front face of the head to remove dirt, paint, corrosion, oxidation or plating therefrom;

finish machining the front face so that it is substantially flat; and forming a pattern in the front face by an electrical discharge machining process which heat treats the face, reduces the surface area of the club face which contacts the ball and increases substantially the coefficient of friction of the face, said pattern including a plurality of intersecting lines which define a plurality of pits.

2. A method as defined by claim 1 wherein the step of machining the front face maintains flatness to a dimensional tolerance of about 0.001 inches, and said pits have centers spaced at about 0.040 inches and each have a depth of about 0.013 inches.

3. A method as defined by claim 1 wherein said pattern has a generally waffle configuration.

4. A method as defined by claim 3 wherein the step of machining the front face maintains flatness to the dimensional tolerance of about 0.001 inches, said pits have centers spaced at about 0.040 inches, and said pits each have a depth of about 0.013 inches.

5. A method as defined by claim 4 wherein said front face has a coefficient of friction in excess of 11.5, and said pits have spaced centers within the range of 0.040 inches to 0.160 inches and a depth within the range of about 0.013 inches to 0.035 inches.

6. A golf club having a head defining a face finished by the method of claim 5.

7. A method as defined by claim 1 wherein said pattern has a generally diamond configuration.

8. A method as defined by claim 7 wherein the step of machining the front face maintains flatness to the dimensional tolerance of about 0.001 inches, said pits have centers spaced at about 0.040 inches, and said pits have a depth of about 0.013 inches.

9. A method as defined by claim 8 wherein said front face has a coefficient of friction in excess of 11.5, and said pits have spaced centers within the range of 0.040 inches to 0.160 inches and a depth within the range of about 0.013 inches to 0.035 inches.

10. A golf club having a head defining a face finished by the method of claim 9.

11. A method as defined by claim 1 wherein said front face has a coefficient of friction in excess of 11.5, and said pits have spaced centers within the range of 0.040 inches to 0.160 inches and a depth within the range of about 0.013 inches to 0.035 inches.

12. A golf club comprising:

a shaft;

a club head secured to said shaft, said club head defining a golf ball striking surface, said surface being substantially flat and having a flatness deviation of less than 0.005 inches, said surface further having a pattern thereon having structural characteristics corresponding to those resulting from machining a surface by an electrical discharge making process which reduces surface contact area, increases the coefficient of friction of the surface, and increases surface hardness.

13. A golf club as defined by claim 12 wherein said face deviation is about ±0.001 and the pattern includes a plurality of pits on centers within the range of 0.040 to 0.160 inches and having depths within the range of 0.013 to 0.035 inches.

14. A golf club as defined by claim 12 wherein said pattern is a waffle configuration.

15. A golf club as defined by claim 14 wherein said face deviation is about ±0.001 inches and the pattern includes a plurality of pits on centers within the range of 0.040 to 0.160 inches and having depths within the range of 0.013 to 0.035 inches.

16. A golf club as defined by claim 12 wherein said pattern is a diamond configuration.

17. A golf club as defined by claim 16 wherein said face deviation is about ±0.001 inches and the pattern includes a plurality of pits on centers within the range of 0.040 to 0.160 inches and having depths with the range of 0.013 to 0.035 inches.

18. A golf club as defined by claim 12 wherein said pattern includes a plurality of perpendicular lines bounding a plurality of pits, said pits being spaced on centers of about 0.040 inches and having depths of about 0.013 inches.

19. A golf club as defined by claim 18 wherein said pattern is a waffle pattern.

20. A golf club as defined by claim 19 wherein said pattern is a diamond pattern.

* * * * *